US011242708B1

(12) United States Patent
Hall

(10) Patent No.: US 11,242,708 B1
(45) Date of Patent: Feb. 8, 2022

(54) DOOR COVER SYSTEM AND METHOD OF USE

(71) Applicant: Jeffery B. Hall, Denver, CO (US)

(72) Inventor: Jeffery B. Hall, Denver, CO (US)

( * ) Notice: Subject to any disclaimer, the term of this patent is extended or adjusted under 35 U.S.C. 154(b) by 30 days.

(21) Appl. No.: 16/417,835

(22) Filed: May 21, 2019

Related U.S. Application Data

(60) Provisional application No. 62/674,208, filed on May 21, 2018.

(51) Int. Cl.
*E06B 3/00* (2006.01)
*E06B 3/70* (2006.01)

(52) U.S. Cl.
CPC ..... *E06B 3/7001* (2013.01)

(58) Field of Classification Search
CPC . B44C 1/10; B44C 5/04; E06B 3/7001; Y10T 428/24008; Y10T 428/24777
USPC ..... 49/507; 428/99; 160/103; 150/154
See application file for complete search history.

(56) References Cited

U.S. PATENT DOCUMENTS 5,255,737 A * 10/1993 Gentry ..... F28F 9/0132 165/159
5,351,733 A * 10/1994 Ullman ..... E06B 7/28 150/154
5,603,194 A * 2/1997 Fridlyand ..... E06B 3/7001 109/49.5
6,029,409 A * 2/2000 Wilson ..... E04G 21/30 150/154
6,395,369 B1 * 5/2002 Randone ..... B32B 5/26 160/10
9,267,323 B2 * 2/2016 Whooley ..... E06B 9/02
9,945,173 B2 * 4/2018 Boyer, Jr. ..... E06B 3/308
2006/0115620 A1 * 6/2006 Anderson ..... B32B 38/145 428/99
2010/0108210 A1 * 5/2010 Salas Garcia ..... A47H 21/00 150/154
2010/0255227 A1 * 10/2010 Hisle ..... B44C 5/04 428/34.1
2011/0296666 A1 * 12/2011 Silverman ..... B44C 1/10 29/450
2013/0105092 A1 * 5/2013 Rainaldi ..... E06B 3/7001 160/103
2018/0058138 A1 * 3/2018 Binder ..... B44C 5/04

* cited by examiner

*Primary Examiner* — Chi Q Nguyen
(74) *Attorney, Agent, or Firm* — Leavitt Eldredge Law Firm

(57) ABSTRACT

A door cover system includes a removable and washable cover body having a first side edge extending to a second side edge; a top edge extending to a bottom edge; and a front surface and a back surface; a decorative pattern on the front surface of the cover body; and at least one fastener; the cover body is to cover a least a portion of a door and the fastener is to secure the cover body onto the door, and the decorative pattern may comprise but is not limited to a solid color, graphics, pictures, logos, holiday themes or any combination thereof.

8 Claims, 3 Drawing Sheets

DOOR COVER SYSTEM AND METHOD OF USE

BACKGROUND

1. Field of the Invention

The present invention relates generally to a door covering system and methods of use. More specifically, the invention is related to a system and method to cover or decorate a door.

2. Description of Related Art

Systems and methods for covering and decorating doors is well known in the art. At time, it is required to cover a door that has been damaged or to cover it to match the style of the room. Additionally, it is often required to decorate a door for a party or other event.

FIG. 1 depicts a conventional door, having a door body 103, secured within a frame 104 via one or more hinges 105. The door body 103 has a front surface 109 with one or more handles and a back surface (not shown) and extends from a top 113 to a bottom 115.

One of the problems commonly associated with a conventional process is the limited use. Often the way to cover or decorate the door is permanent, such as painting, lacquer or stain. Other times, individual decorations for a party or event must be put up with tape or putty which can be time consuming and may damage the door upon removal.

Although great strides have been made in the area of door covering systems and methods of use, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
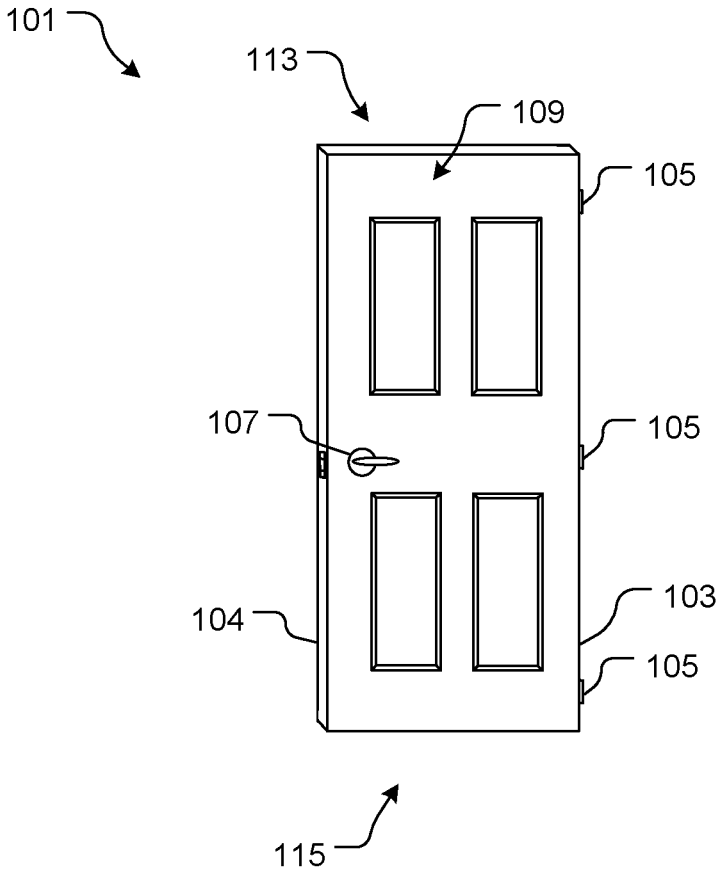
FIG. 1 (Prior Art)
FIG. 1 is a simplified schematic of a conventional door.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems and methods to cover and decorate doors. Specifically, the present invention is directed to a reusable and washable door cover that allows the user to easily and quickly cover and decorate a door for a party, event, or for room decor. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 3:
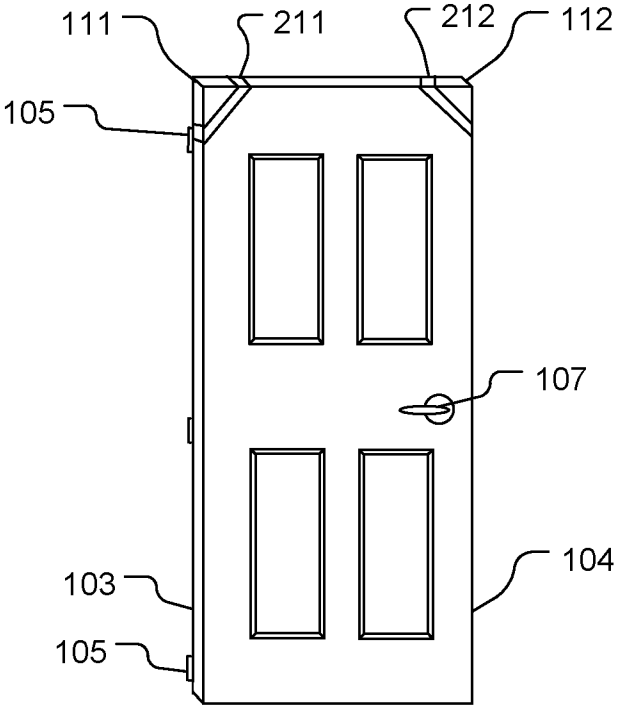
FIG. 3 is a back view of the cover of the system of FIG. 2 in accordance with the preferred method of use.
Figure 2:
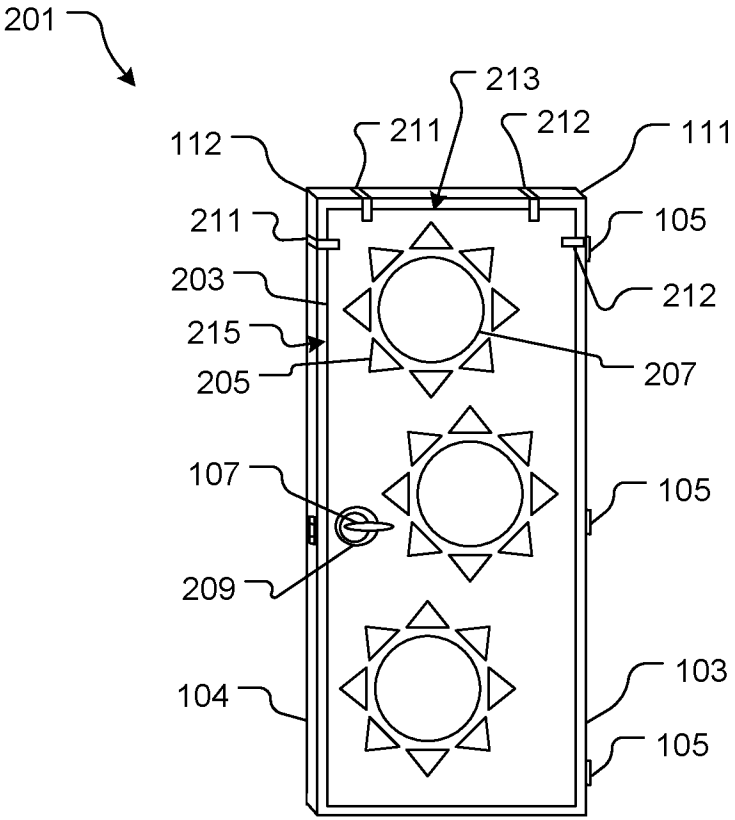
FIG. 2 is a simplified schematic of a system and method of the present invention in accordance with the preferred embodiment of the present invention.
Figure 4:
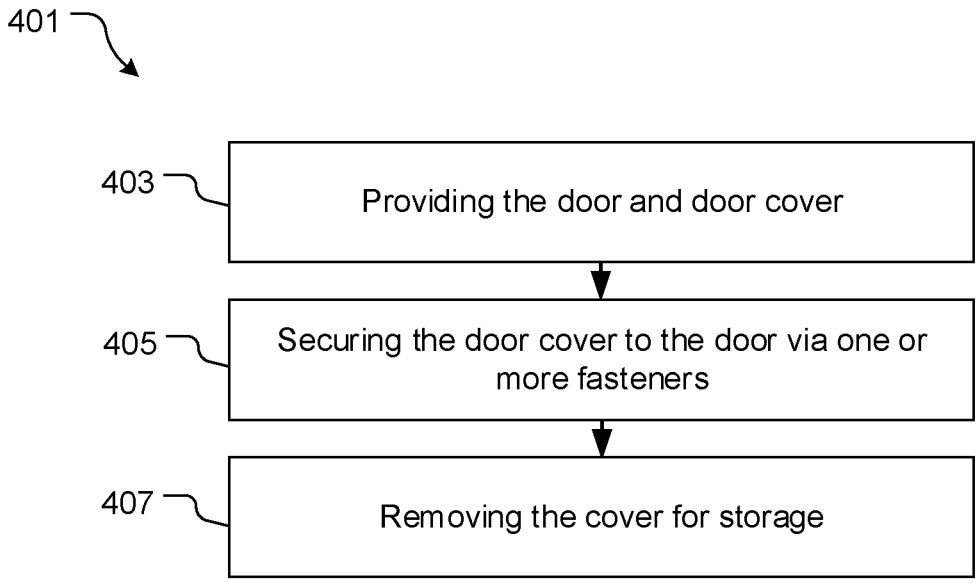
FIG. 4 is a flowchart depicting the preferred method of use.

Referring now to the drawings wherein like reference characters identify corresponding or similar elements throughout the several views, FIGS. 2-4 depict various views of a system 201 and method of use in accordance with a preferred embodiment of the present application. It will be appreciated that system 201 overcomes one or more of the above-listed problems commonly associated with the conventional systems and methods to cover or decorate a door.

In the contemplated embodiment, system 201 includes one or more of the same features as the conventional door system 101; however, it is contemplated utilizing a cover 203 and a set of straps 205 configured to overcome the problems commonly associated with conventional door covering or decorating processes.

Referring to FIG. 2, a front side of a conventional door 101 is shown with a door cover 203 with two straps 211, 212 configured to wrap around the top corners 111,112 of the door and secure the cover 203 onto the door 101. The cover 203 is shown having a customized pattern 205 and attached decorations 207. Additionally, the cover is shown having an aperture 209 to allow the door knob 107 to be visible and usable.

Referring now to FIG. 3, a back side of a conventional door 101 is shown with a door cover 203 with two straps 211, 212 configured to wrap around the top corners 111,112 of the door and secure the cover 203 onto the front side 103 of the door 101. It is contemplated that the straps 211,212 are configured as long rectangular pieces of material having two distal ends, wherein one end of the strap 211 is attached to the top edge 213 of the cover 203 and the opposite end of the strap 211 is attached to a side edge 215 of the cover 203.

It is anticipated that the cover 203 could be made with different configurations of the straps 211,212. In one alternate embodiment, the cover 203 could be made with four separate straps configured to wrap around each of the four corners of the door 101. Alternatively, the cover 203 could be made with a single strap configured to wrap around the door vertically or horizontally to secure the cover 203 onto the door 101.

In one contemplated embodiment, the straps 211,212 could be composed of a stretchy material such as elastic. In an alternate embodiment, the straps could be composed of a Velcro material, rope or other suitable fastener that is configured to secure the cover 203 onto the door 101. In an alternate embodiment, the cover 203 could be configured with one or more apertures configured to loop or slide onto one or more hooks attached to the door.

In one contemplated embodiment, the cover 203 could be composed of a flexible material that allows the door cover 203 to be folded or rolled up and easily stored. However, it should be understood that the walls could be composed of any material suitable to covering a door. The material could be a fabric such as canvas that is more durable, or it could be a stretch fabric such as Spandex that allows for the cover 203 to fit tightly and be flush with the door 101.

In one contemplated embodiment, the cover 203 is composed of a single sheet of material. The edges of the cover could be hemmed to offer a finished, polished look. In an alternate embodiment, the cover 203 could be configured to be reversible wherein both the front and back sides of the cover have decorations. In another embodiment, the cover 203 could be configured to have a sheet of decorative material that is lined with a plain sheet of material for durability or for a more polished look if the door is transparent.

In one embodiment, the door cover 203 could be manufactured with a specific theme of decorations, such as for Christmas, Halloween or a birthday celebration. These decorations could include a two-dimensional pattern or graphics printed onto the cover or as part of the original material or fabric used in construction. The decorations could also include three-dimensional objects attached to the cover. It is also anticipated that the cover could be configured to have pockets to hold and store items or removable decorations. In an alternate embodiment, the door cover 203 could be manufactured plain so that the user can decorate the cover 203 to his or her own specifications.

In FIG. 4, a flowchart 401 depicts the preferred method of use as shown in boxes 403-407. The method includes providing a door 101 and a door cover 203 as discussed above and securing the door cover 203 to the door 101 via one or more fasteners. Once the party or event is over, the door cover 203 can be easily removed via the fasteners and stored until further use.

In the preferred embodiment, the cover 203 may be configured to fit a standard indoor door with dimensions of 1981 mm×762 mm (6 ft 6 in×2 ft 6 in). It is anticipated however, that the cover 203 may be configured to fit any size door, exterior or interior. Additionally, it is anticipated that the cover 203 may be configured to fit smaller doors such as cabinet doors.

In an alternate embodiment, the cover 203 could be configured to cover both the front side 103 and back side 104 of the door, utilizing similar straps 211,212 as discussed above.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A door cover system, comprising:
a removable and washable cover body having:
a first side edge extending to a second side edge;
a top edge extending to a bottom edge;
a front surface and a back surface;
the removably and washable cover is configured to cover an entire front surface of a door;
an opening extending through a thickness of the removable and washable cover, the opening is configured to receive a door knob of the door;
a decorative pattern on the front surface of the removable and washable cover body; and
at least one fastener that is a strap having:
a body that extends from a first distal end to a second distal end, the body is composed of an elastic material;
wherein the first distal end is connected to a first edge of the removable and washable cover body and the second distal end is connected to a second edge of the removable and washable cover body;
wherein the fastener is configured to secure the removable and washable cover body onto the door, and
wherein the decorative pattern comprises but is not limited to a solid color, graphics, pictures, logos, holiday themes or any combination thereof.

2. The system of claim 1, further comprising:
a first strap having two distal ends;
a second strap having two distal ends;
wherein the first strap is configured such that the first distal end is connected to the top edge of the removable and washable cover and the second distal end is connected to the first side edge of the cover, and the second strap is configured such that the first distal end is connected to the top edge of the removable and washable cover and the second distal end is connected to the second edge of the cover.

3. The system of claim 2, further comprising:
an interior door having:
a front surface;
a back surface;
a set of hinges;
a door handle;
a first top corner; and
a second top corner;
wherein the removable and washable cover body is configured to cover the front surface of the door, and wherein the first strap is configured to wrap around the first top corner of the door and the second strap is configured to wrap around the second top corner of the door.

4. The system of claim 1, wherein the back surface further comprises:
a decorative pattern,
wherein the removable and washable cover body is reversible.

5. The system of claim 1, further comprising:

decorations configured as three-dimensional objects that attach onto the front surface of the cover.

6. The system of claim 1, wherein the removable and washable cover body is configured to cover the front surface of a door that has dimensions of or similar to a standard interior door of 6 ft 6 in×2 ft 6 in.

7. The system of claim 1, wherein the removable and washable cover body is configured to cover any door size, wherein a user is able to customize the dimensions of the cover body.

8. The system of claim 1, wherein the removable and washable cover body is configured to cover a front side and a back side of the door.

* * * * *